United States Patent [19]

Worsham et al.

[11] Patent Number: 4,773,888

[45] Date of Patent: Sep. 27, 1988

[54] SCARECROW DOLL

[76] Inventors: Irma A. Worsham, 123 Mary Miles Dr., Danville, Va. 24540; George Spector, 233 Broadway, Rm. 3815, New York, N.Y. 10007

[21] Appl. No.: 906,508

[22] Filed: Sep. 12, 1986

[51] Int. Cl.[4] ..... A63H 3/28

[52] U.S. Cl. ..... 446/303; 446/484

[58] Field of Search ..... 446/303, 297, 392, 485, 446/484, 298, 299, 300, 301, 302, 397, 405, 408, 409; 434/258, 260; 40/442, 411

[56] References Cited

U.S. PATENT DOCUMENTS

| | | | |
|---|---|---|---|
| 3,488,053 | 1/1970 | Patel | 434/258 X |
| 3,949,488 | 4/1976 | Welch | 446/302 X |
| 4,267,551 | 5/1981 | Dankman et al. | 446/303 X |
| 4,305,223 | 12/1981 | Ho | 446/392 |

*Primary Examiner*—Mickey Yu

[57] ABSTRACT

A scarecrow doll is provided and consists of various switches within the doll to produce audible and visual indications such as a switch in the nose to light the eyes, a switch in the stomach to make a sound and a switch in the mouth to light the eyes and make the sound together.

4 Claims, 1 Drawing Sheet

SCARECROW DOLL

BACKGROUND OF THE INVENTION

The instant invention relates generally to dolls and more specifically it relates to a scarecrow doll.

Numerous dolls have been provided in prior art that are adapted to contain sounding mechanisms so that dolls will emit sounds therefrom. For example, U.S. Pat. Nos. 3,504,455; 4,249,338 and 4,451,911 all are illustrative of such prior art. While these units may be suitable for the particular purpose to which they address, they would not be as suitable for the purposes of the present invention as heretofore described.

SUMMARY OF THE INVENTION

A primary object of the present invention is to provide a scarecrow doll that will overcome the shortcomings of the prior art devices.

Another object is to provide a scarecrow doll that by manually operating various switches on the body of the doll audible and visual indications will be produced.

An additional object is to provide a scarecrow doll in which a switch in the nose will light the eyes, a switch in the stomach will make a sound and a switch in the mouth will light the eyes and make the sound.

A further object is to provide a scarecrow doll that is simple and easy to use.

A still further object is to provide a scarecrow doll that is economical in cost to manufacture.

Further objects of the invention will appear as the description proceeds.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
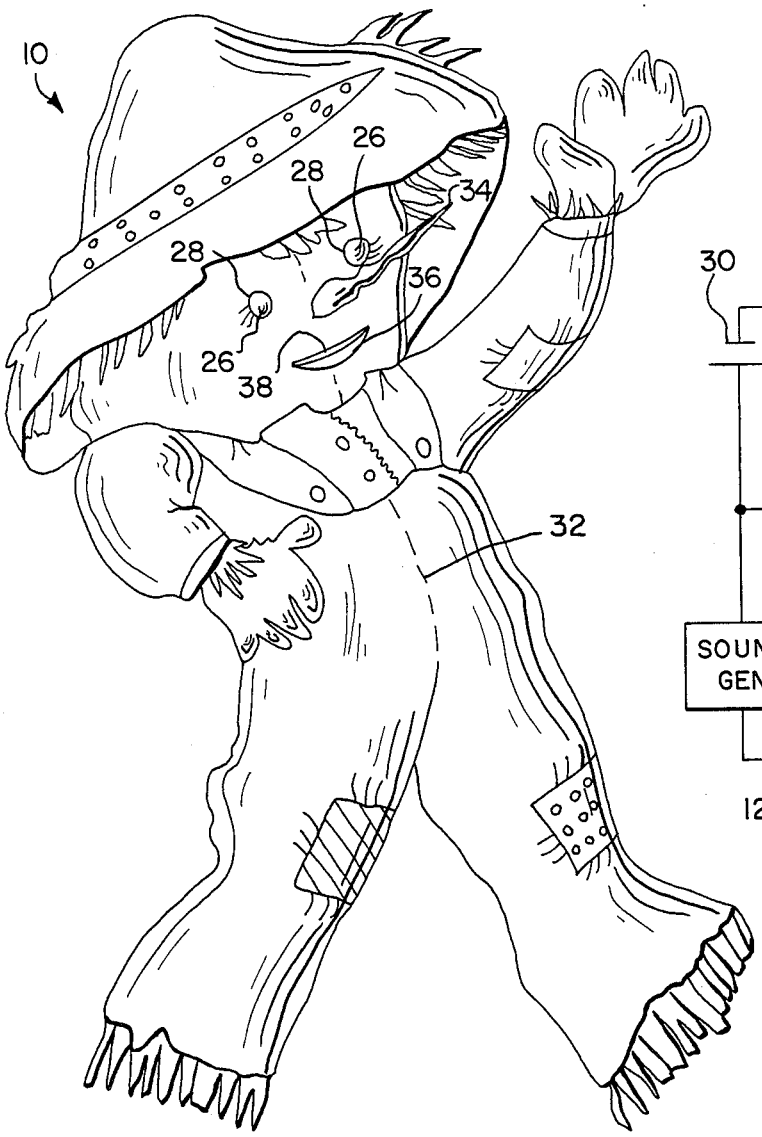
FIG. 1 is a perspective view of the invention.
Figure 2:
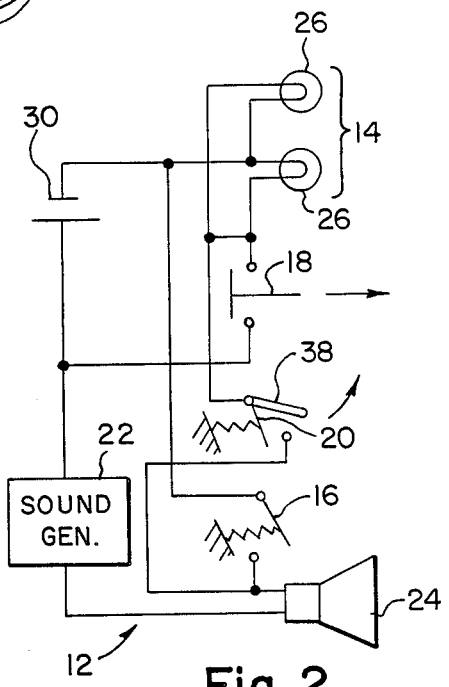
FIG. 2 is an electrical circuit showing switch on nose to light eyes, switch on stomach to make sound and switch on lip to light eyes and make sound together.
Figure 3:
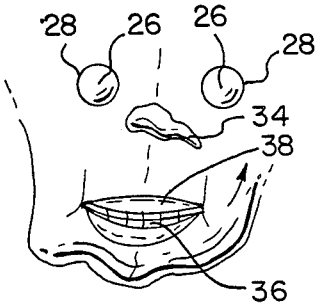
FIG. 3 is a partial front view of the doll head showing the lip up to activate the switch within.

Turning now descriptively to the drawings, in which similar reference characters denote similar elements throughout the several views, FIGS. 1 to 3 illustrates a scarecrow doll 10 that contains an electrical audio indicator 12 and an electrical video indicator 14 within. A first switch 16 is for activating the audio indicator 12, a second switch 18 is for activating the video indicator 14 and a third switch 20 is for activating both the audio indicator 12 and video indicator 14 together. The switches 16, 18 and 20 are all within the scarecrow doll 10.

The audio indicator 12 includes a sound generator 22 and a speaker 24 to emit sounds therefrom. The video indicator 14 includes a pair of lamps 26 located within eyes 28 of the scarecrow doll 10 to emit light therefrom. The audio indicator 12 and the video indicator 14 are both powered by a battery 30 located within the scarecrow doll 10.

The first switch 16 is a normally open spring biased switch located in stomach 32 of the scarecrow doll 10 and is activated when the stomach 32 is pushed in. The second switch 18 is normally open button switch located in nose 34 of the scarecrow doll 10 and is activated when the nose 34 is pulled on. The third switch 20 is a normally open spring biased switch located in mouth 36 of the scarecrow 10 and is activated when upper lip 38 is pulled up.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A scarecrow doll having eyes, a nose, a mouth, lips and a stomach comprising:

(a) an electrical audio indicator within said scarecrow doll;

(b) an electrical video indicator within said eyes;

(c) a first switch within said scarecrow doll for activating said audio indicator;

(d) a second switch within said scarecrow doll for activating said video indicator; and (e) a third switch within said scarecrow doll for activating both said audio indicator and video indicator together; and (f) power means in said doll for energizing said indicators.

2. A scarecrow doll as recited in claim 1, wherein said first switch is located in said stomach and is activated when said stomach is pushed in.

3. A scarecrow doll as recited in claim 1, wherein said third switch is located in said mouth and is activated by manipulation of one of said lips.

4. A scarecrow doll as recited in claim 1, wherein said video indicator includes a pair of lamps located within said eyes including means for actuating said second switch by pulling said nose.

* * * * *